US005739095A

United States Patent [19]

Langguth et al.

[11] Patent Number: 5,739,095

[45] Date of Patent: Apr. 14, 1998

[54] SOLID PEROXYHYDRATE BLEACH/ DETERGENT COMPOSITION AND METHOD OF PREPARING SAME

[75] Inventors: Robert P. Langguth, Overland; Michael Oberlander, Kansas City, both of Mo.

[73] Assignee: Noramtech Corporation, Kansas City, Mo.

[21] Appl. No.: 736,984

[22] Filed: Oct. 25, 1996

[51] Int. Cl.[6] ..... C11D 7/18

[52] U.S. Cl. ..... 510/367; 510/373; 510/375

[58] Field of Search ..... 510/367, 373, 510/375

[56] References Cited

U.S. PATENT DOCUMENTS

| | | | |
|---|---|---|---|
| 2,121,952 | 6/1938 | Colonius et al. . | |
| 3,140,149 | 7/1964 | Habernickel | 510/375 |
| 3,933,672 | 1/1976 | Bartolotta et al. . | |
| 4,005,182 | 1/1977 | Ito et al. . | |
| 4,179,394 | 12/1979 | Dillenburg et al. . | |
| 4,430,244 | 2/1984 | Broze et al. . | |
| 4,595,520 | 6/1986 | Heile et al. . | |
| 4,618,445 | 10/1986 | Madan | 510/375 |
| 4,637,890 | 1/1987 | Crabtree et al. . | |
| 4,652,392 | 3/1987 | Baginski et al. . | |
| 4,680,134 | 7/1987 | Heile et al. . | |
| 4,686,060 | 8/1987 | Crabtree et al. . | |
| 5,049,298 | 9/1991 | Ploumen et al. . | |
| 5,244,593 | 9/1993 | Roselle et al. . | |
| 5,298,180 | 3/1994 | Dixit . | |
| 5,374,368 | 12/1994 | Hauschild . | |
| 5,478,488 | 12/1995 | Doetsch et al. | 510/375 |

*Primary Examiner*—Jacqueline V. Howard

*Attorney, Agent, or Firm*—Hovey, Williams, Timmons & Collins

[57] ABSTRACT

A solid oxygen-based bleach includes components such as aqueous hydrogen peroxide combined with a quantity of an alkali metal phosphate capable of combining with the hydrogen peroxide to form a peroxyhydrate salt. A sufficient amount of a solidifying agent for the peroxyhydrate salt is added to the mixture while still in its exothermically heated form, to effect solidification of the emulsion upon cooling of the product. The pH of the composition is controlled by addition of sequestering acid salts to maintain the pH within 4 to 9, and preferably 7 to 8. Anionic and/or nonionic surfactants may be added to the composition. The heated molten composition resulting from the exothermic reaction of the constituents is poured into tablet or cake forming molds and allowed to cool thus effecting solidification of the mass in each mold.

The bleaching/detergent composition is useful in hot water warewashing, laundry, and hard surface cleaning applications.

15 Claims, No Drawings

SOLID PEROXYHYDRATE BLEACH/ DETERGENT COMPOSITION AND METHOD OF PREPARING SAME

BACKGROUND OF THE INVENTION

1. Field of the Invention

This invention relates to a solid bleaching composition and method of preparing the same, and particularly to a bleaching composition that is the reaction product of hydrogen peroxide and an alkali metal phosphate salt capable of forming a peroxyhydrate with the hydrogen peroxide. Preferably, a synthetic organic surfactant is included in the bleaching composition. The solid bleaching composition may be used for warewashing, laundry, or general hard surface cleaning.

2. Description of the Prior Art

Bleaching agents have been widely used as an adjunct to detergents for household and industrial dish washing, laundering, and general hard surface cleaning applications, because of the improved cleaning results that are directly attributable to the bleaching composition. There are two major classes of bleaches commonly employed in existing detergent compositions. One class is chlorine based; the other class is oxygen-based. Powdered bleaching agents, with or without a detergent component, offer cleaning advantages to the user, are highly effective, and may be packaged in a form that is not subject to the spillage and container rupture problems which are indigent to liquid bleaches.

Examples of powdered oxygen bleaches that have been in use for some time include sodium perborate, sodium percarbonate, and potassium monopersulfate. These solid bleaches have been used to advantage in specific operations, or were incorporated into particular cleaning formulations to provide a desirable desraining function while retaining the cleaning function of the detergent constituents.

Recently, chlorine-based bleaches have come into public scrutiny because of toxic residues which become an undesirable part of the environment. Oxygen-based bleaches on the other hand are essentially environmentally safe.

However, in order for the bleaching composition to be effective, it is necessary that the components of the solid bleaching composition be uniformly distributed throughout the bleaching agent body. Furthermore, the solid bleaching agent body must dissolve readily in the aqueous washing medium in which the bleaching composition is used. Homogeneous solid detergent compositions containing active chlorine and water conditioning agents have been described in a number of earlier patents, but as noted, chlorine containing compositions of this nature are coming under increasing governmental scrutiny because of environmental pollution concerns.

There remains a need for a homogeneous solid bleaching composition containing active oxygen and water conditioning agents which will readily dissolve in hot water. Furthermore, the solid bleaching composition should be resistant to loss of valuable bleaching oxygen, and be free of the production of toxic residues which can pollute the environment.

SUMMARY OF THE INVENTION

This invention relates to a solid oxygen based bleach made up of aqueous hydrogen peroxide which is stabilized with a condensed phosphate hardness sequestering agent. The bleaching composition comprises a quantity of the reaction product of from about 5% to about 25% by weight of aqueous hydrogen peroxide with a quantity of an alkali metal phosphate capable of combining with the hydrogen peroxide to form a stable peroxyhydrate salt. The solid bleaching composition therefore lends itself to be readily formulated with effective levels of organic surfactants and other functional ingredients necessary for the specific cleaning function desired.

In particular, it has been discovered that stable aqueous slurries of the hydrogen peroxide based composition can be solidified by incorporating peroxyhydrate forming phosphate salts accompanied by other anhydrous salt solidifying agents which hydrate and further solidify the slurry. These agents form perhydrate salts from the hydrogen peroxide and serve to bind free water present in the slurry to a point where the liquid slurry is hardened or solidified as a homogeneous solid.

Heat generated in the formation of the perhydrate salts increases the solubility of these salts such that an slurry is formed that can be readily poured into molds. Hydration of ingredients on cooling in the mold effects solidification. Desirably, a surfactant is incorporated in the formulation thus producing a molded tablet or cake having a wide array of cleaning uses. The molded product is especially useful for high temperature warewashing and laundry applications, as well as for other hard surface cleaning duties.

DETAILED DESCRIPTION OF THE PREFERRED EMBODIMENTS

A quantity of aqueous hydrogen peroxide is first admixed with an amount of an alkali metal phosphate capable of combining with the hydrogen peroxide to form a peroxyhydrate salt. Desirably, from about 5% to about 25% by weight in water of aqueous hydrogen peroxide is combined with an alkali metal salt of orthophosphoric acid, pyrophosphoric acid, or tripolyphosphoric acid. The peroxyhydrate-forming phosphate is an alkali metal orthophosphate, pyrophosphate, or tripolyphosphate with an alkali metal to phosphorous mol ratio of 1/1 to 2/1.

The preferred phosphate salt is sodium pyrophosphate. Other alkali salts of the three phosphoric acid agents can be effectively used, including monosodium or monopotassium orthophosphate, disodium or dipotassium orthophosphate, tetrasodium or tetrapotassium pyrophosphate, tetrasodium or tetrapotassium acid pyrophosphate, and pentasodium or pentapotassium tripolyphosphate, or mixed sodium potassium salts. These phosphate salts should be present in an amount from about 1.5 to about 3 times the active hydrogen peroxide content on a weight basis to function properly.

The pH of the water/hydrogen peroxide/phosphate mixture should be controlled through use of a non-oxygen reactive agent which is stable in the presence of hydrogen peroxide and at the concentration used is capable of maintaining the pH composition in the range of from about 4 to about 9. Acidic sequestering agents and acid salts of sequestering agents are the preferred pH control additive in order to minimize the loss of active oxygen from the hydrogen peroxide during processing. The preferred pH range is from about 7 to about 8. Exemplary acidic sequestering agents, and acid salts of sequestering agents include those which form sequestering salts such as aminotri(methylenephosphonic acid), 1-hydroxyethylidenediphosphonic acid, ethylenediaminetetraacetic acid, polyacrylic acid, and derivatives thereof. These sequestering acid salts also protect the hydrogen peroxide from rapid decomposition as a result of traces of iron, copper, manganese, and similar contaminants that may be present in the water and other ingredients in the composition.

It is also preferred that a sufficient amount of an alkali metal phosphate solidifying agent be added to the composition to assure formation of a solid mass upon cooling of the composition. Useful solidifying agents include alkali metal pyrophosphates and tripolyphosphates, as well as non-alkaline constituents such as sodium sulfate or sodium chloride. Mixtures of the solidifying agents may be used if desired.

Where sodium tripolyphosphate is used as a solidifying agent along with sodium sulfate and/or sodium chloride, the sodium tripolyphosphate functions as a solidifying agent while at the same time serving to combine with and stabilize hydrogen peroxide that is not perhydrated with the other phosphates. The sodium tripolyphosphate is preferably present at a level of about 20% to about 35% by weight of the total composition.

When the bleaching composition is also to be used as a warewashing or laundry detergent, it is preferably formulated to contain effective amounts of synthetic organic surfactants. The surfactants must be chosen so as to be stable and chemically compatible in the presence of the hydrogen peroxide. One class of useful surfactants are the anionic surfactants. Preferred anionic surfactants include alkali metal alkylbenzene sulfonates, alkali metal alkyl ether sulfates, alkali metal alkyl sulfates, alkali metal alpha olefin sulfonates, and mixtures thereof.

Nonionic surfactants may also be employed either alone or in combination with the anionic surfactants. This class of synthetic detergents may be broadly defined as compounds produced by the condensation of alkylene oxide groups with an organic hydrophobic compound, which may be aliphatic or alkyl aromatic in nature. Preferred nonionic surfactants include polyethylene oxide condensates of alkylphenols, polyoxyethylene condensate of a hydrophobic polypropylene oxide/propylene glycol condensate, alkyl polyglucosides, and alkyl amine oxides.

The amount of organic surfactants added to the bleaching composition varies depending on the intended use of the composition. As an example, an effective laundry detergent-bleaching composition may be prepared containing 3%–15% of the surfactant agent.

The bleaching and/or detergent composition is preferably manufactured by combining the aqueous liquid hydrogen peroxide and the alkali metal phosphate capable of forming a peroxyhydrate salt reaction product with the hydrogen peroxide. Heat generated during the formation of the perhydrate salts increases the solubility of these salts such that an molten emulsion is formed. The solidifying agent(s), along with the surfactant and other detergent adjuvant of choice, are added with mixing after the temperature of the reaction product has decreased to a range of from about 90° F. to about 120° F. The resultant molten product can be easily poured into suitable molds of desired size. The slurry is allowed to cool to a solid mass in respective molds, thereby producing tablets or respective cast objects.

A preferred bleaching/detergent composition is made up of the following constituents in the relative ratios set out.

| Constituent | % by weight |
|---|---|
| Hydrogen peroxide | 22.0% |
| aminotrimethylene phosphonic acid (DEQUEST 2000) | 5.0% |
| Colloid 207 | 4.0% |
| Water, distilled | 3.0% |

-continued

| Constituent | % by weight |
|---|---|
| Tetrasodium pyrophosphate | 9.0% |
| Tetrapotassium pyrophosphate | 9.0% |
| Sodium sulfate filler | 2.0% |
| Triton N-101 (alkylnonyl phenol ethoxylate containing 9 mols of ethylene oxide) | 7.0% |
| APG-325 (nonionic alkylated polyglucoside) | 3.0% |
| Steol CS-460 (alkyl ether sulfate) | 1.0% |
| Carboxymethyl cellulose filler | 1.0% |
| Tinopal 5BM (fluorescent whitening agent) | 0.3% |
| Sodium tripolyphosphate powder | 0.7% |

A feature of the invention is the discovery that by using a combination of sodium pyrophosphate and potassium pyrophosphate, the final solid material is more readily soluble in water than is the case where sodium pyrophosphate alone is used. A combination of the two pyrophosphates present in equal amounts provides a final product which is significantly more soluble in water than is the case when only one of the pyrophosphates is present in the same concentration as the single pyrophosphate additive.

The solid detergent/bleach compositions as described are stable during storage at ambient conditions, and rapidly disperse in cold or hot water when introduced into standard washing equipment. The bleaching/detergent compositions may be introduced to the cleaning equipment at concentrations ranging from 0.05% to about 0.5% by weight and provide effective destaining and cleaning results.

We claim:

1. A bleaching composition comprising:

a quantity of the reaction product of from about 5% to about 25% by weight of aqueous hydrogen peroxide with a quantity of an alkali metal phosphate capable of combining with the hydrogen peroxide to form a peroxyhydrate salt;

a sufficient amount of a solidifying agent for the peroxyhydrate salt to form a solid material; and a sufficient amount of a non-oxygen reactive sequestering agent selected from the group consisting of acidic sequestering agents and acid salts of sequestering agents, said sequestering agent being capable of maintaining the pH of the composition in the range of from about 4 to about 9.

2. A bleaching composition as set forth in claim 1, wherein said solidifying agent is an alkali metal pyrophosphate.

3. A bleaching composition as set forth in claim 1, wherein said solidifying agent is a tripolyphosphate.

4. A bleaching composition as set forth in claim 1, wherein said solidifying agent is sodium sulfate.

5. A bleaching composition as set forth in claim 1, wherein said solidifying agent is a mixture of sodium sulfate and sodium chloride.

6. A bleaching composition as set forth in claim 1, wherein said solidifying agent is a mixture of a tripolyphosphate and sodium sulfate.

7. A bleaching composition as set forth in claim 1, wherein said alkali metal phosphate is selected from the group consisting of alkali metal salt of orthophosphoric acid, alkali metal salt of pyrophosphoric acid, and alkali metal salt of tripolyphosphoric acid with an alkali metal to phosphorous mol ratio of 1/1 to 2/1.

8. A bleaching composition as set forth in claim 7, wherein said alkali metal phosphate is sodium pyrophosphate.

9. A bleaching composition as set forth in claim 1, wherein the alkali metal salt is present in an amount of from about 1.5 to about 3 times the active hydrogen peroxide content of the reaction product.

10. A bleaching composition as set forth in claim 1, wherein said non-oxygen reactive agent is an acid which forms a sequestering salt selected from the group consisting of aminotri(methylene-phosphonic acid), 1-hydroxyethylidenediphosphonic acid, ethylenediaminetetraacetic acid, polyacrylic acid, and derivatives thereof.

11. A bleaching composition as set forth in claim 1, wherein composition includes an effective amount of a synthetic organic surfactant.

12. A bleaching composition as set forth in claim 1, wherein said composition is a formed body that was hardened in a mold.

13. A method of preparing a bleaching composition comprising the steps of:

combining from about 5% to about 25% by weight of aqueous hydrogen peroxide with an alkali metal phosphate capable of forming a peroxyhydrate salt reaction product with the aqueous hydrogen peroxide;

adding a sufficient quantity of a non-oxygen reactive sequestering agent to the reaction product to maintain the pH thereof within the range of about 4 to about 9, said sequestering agent being selected from the group consisting of acidic sequestering agents and acid salts of sequestering agents;

adding an amount of a solidifying agent to the peroxyhydrate salt reaction product to effect solidification thereof;

pouring the admixture of peroxyhydrate salt reaction product, solidifying agent, and sequestering agent into a mold; and allowing the peroxyhydrate salt reaction product, a solidifying agent and sequestering agent to cool in the mold to produce a hardened mass.

14. A method of preparing a bleaching composition as set forth in claim 13, wherein is included the step of adding the solidifying agent to the reaction product which has cooled to a temperature of from about 90° F. to about 120° F.

15. A method of preparing a bleaching composition as set forth in claim 13, wherein is included the step of incorporating a surfactant in the reaction product prior to solidification thereof.

* * * * *